US007328460B1

(12) United States Patent
Mancini

(10) Patent No.: US 7,328,460 B1
(45) Date of Patent: Feb. 12, 2008

(54) PANT LEG LOWER END REINFORCING STRUCTURE AND SHOE AND PANT LEG SYSTEM

(76) Inventor: Cheryl Mancini, 8835 NW. 58th Ct., Parkland, FL (US) 33067

( * ) Notice: Subject to any disclaimer, the term of this patent is extended or adjusted under 35 U.S.C. 154(b) by 0 days.

(21) Appl. No.: 11/147,785

(22) Filed: Jun. 8, 2005

(51) Int. Cl.
*A41D 1/00* (2006.01)
*A41D 13/00* (2006.01)

(52) U.S. Cl. ..... 2/232; 2/227

(58) Field of Classification Search ..... 2/227, 2/230–232, 46, 51; 36/70 R, 70 A
See application file for complete search history.

(56) References Cited

U.S. PATENT DOCUMENTS

| | | | | | |
|---|---|---|---|---|---|
| 176,292 | A | * | 4/1876 | Gardner | 2/232 |
| 257,026 | A | * | 4/1882 | Langan | 2/232 |
| 1,211,472 | A | * | 1/1917 | Marcelli | 2/232 |
| 1,381,965 | A | | 6/1921 | Cameron, Jr. | |
| 1,651,775 | A | | 12/1927 | Knapp | |
| 2,483,952 | A | * | 10/1949 | Wayworth | 2/232 |
| 2,488,594 | A | | 11/1949 | Hartlage | |
| 2,574,669 | A | | 11/1951 | Snider | |
| 2,962,724 | A | | 12/1960 | Wilkens | |
| 3,097,364 | A | | 7/1963 | Hess | |
| 3,139,625 | A | | 7/1964 | Isaacs | |
| 4,028,741 | A | | 6/1977 | Henry | |

* cited by examiner

*Primary Examiner*—Gloria M. Hale
(74) *Attorney, Agent, or Firm*—Oltman, Flynn & Kubler

(57) ABSTRACT

A reinforced pant leg system includes pants having two pant legs, each pant leg having a pant leg lower end with a lower end rearward portion; a pair of open back shoes, each open back shoe including a shoe heel having a certain heel height; and a pant leg reinforcing structure fastened to each pant leg lower end rearward portion with a reinforcing structure fastening mechanism and having a height of at least twice the certain heel height; so that the pant leg reinforcing structures prevent the lower end rearward portions from bending sufficiently to become caught between the corresponding open back shoe and a user foot.

7 Claims, 2 Drawing Sheets

PANT LEG LOWER END REINFORCING STRUCTURE AND SHOE AND PANT LEG SYSTEM

BACKGROUND OF THE INVENTION

1. Field of the Invention

The present invention relates generally to the field of garments and garment accessories. More specifically the present invention relates to an upright reinforcing structure with fastening means for attachment to the lower end rearward portion of a pant leg to prevent the lower end rearward portion from bending forwardly and becoming caught between the heel of the wearer foot and the sole of a corresponding open back shoe, and to a shoe and pant leg system combining the reinforcing structure with a pant leg and an open back shoe. The system establishes the height relationships between the reinforcing structure and the shoe heel, namely that the height of the reinforcing structure has at least twice the height of the shoe heel so that the lower end rearward portion cannot bend sufficiently to become caught between the wearer shoe and foot. To define the height independently of a given shoe heel, the height of the reinforcing structure is at least three inches and preferably four inches.

The reinforcing structure preferably takes the form of an elongate reinforcing panel and the panel fastening means preferably takes the form of an adhesive on a panel first face. The panel first face is initially covered by a removable cover sheet, so that the cover sheet can be pealed off the panel and the panel first face placed and affixed upright against the lower end rearward portion inner surface. The reinforcing panel preferably is inexpensive and readily removable from the pant leg to be disposable, so that the pants can be laundered without the panel. The preferred reinforcing panel material is cardstock or cardboard, although a resilient or rigid plastic is also contemplated.

2. Description of the Prior Art

There have long been structures for attachment to a pant leg lower end or cuff for either maintaining the cuff in a laterally full and rounded configuration, or for shielding the pant leg lower end from abrasion. What has been absent in the art is a pant leg lower end reinforcing structure for preventing the lower end rearward portion from bending sufficiently to become caught between the wearer foot and the heel of an open back shoe.

Prior art pant leg supplemental structures for shaping the pant leg or cuff include those of Cameron, Jr., U.S. Pat. No. 1,381,965, issued on Jun. 21, 1921 for a shape retainer for the bottom of trousers legs; Wilkens, U.S. Pat. No. 2,962,724, issued on Dec. 6, 1960 for a plastic ring for blousing of trouser legs; and Hess, U.S. Pat. No. 3,097,364, issued on Jul. 16, 1963 for a device for forming cuffs on trousers which forms a band around the pant leg lower end; Isaacs, U.S. Pat. No. 3,139,625, issued on Jul. 7, 1964 for a cuff for garments; and Henry, U.S. Pat. No. 4,028,741, issued on Jun. 14, 1977 for a plastic blousing block in the form of a tubular structure fitting around a leg lower end.

Prior art pant leg supplemental structures for shielding the pant leg from abrasion damage and soiling from the shoe heel include those of C. S. Knapp, U.S. Pat. No. 1,651,775, issued on Dec. 6, 1927 for a trouser shield for securing about a pant leg rear segment lower edge; F. F. Hartlage, U.S. Pat. No. 2,488,594, issued on Nov. 22, 1949 for a protector for the bottom edges of trousers which fasten with protruding spikes to a pant leg lower end; H. Snider, U.S. Pat. No. 2,574,669, issued on Nov. 13, 1951 for a removable trouser leg bottom guard; and Wayworth, U.S. Pat. No. 2,483,952, issued on Oct. 4, 1949 for a protecting strip for trouser cuffs which is laterally elongated to extend along a partial circumferential path around the pant leg lower end.

It is thus an object of the present invention to provide a pant leg lower end reinforcing structure which fastens to a pant leg lower end rearward portion and extends a sufficient distance along the pant leg longitudinal axis to prevent lower leg rearward portion from bending forwardly sufficiently to become caught between the wearer heel and the heel upper surface of an open backed shoe.

It is another object of the present invention to provide such a reinforcing structure which readily and easily removed from a pant leg after installation without damaging the pant leg.

It is still another object of the present invention to provide such a reinforcing structure which can be trimmed by the purchaser to any desired dimensions if different from provided dimensions.

It is finally an object of the present invention to provide such a reinforcing structure which is easy and inexpensive to produce to such an extent to be disposable prior to each pant laundering.

SUMMARY OF THE INVENTION

The present invention accomplishes the above-stated objectives, as well as others, as may be determined by a fair reading and interpretation of the entire specification.

A reinforced pant leg assembly is provided, including a pant leg having a pant leg lower end with a lower end rearward portion; and elongate reinforcing structure at least three inches in height and having a fastening mechanism for attaching the reinforcing structure to the lower end rearward portion to prevent said lower end rearward portion from bending forwardly and becoming caught between a heel of a wearer foot and the corresponding sole of an open back shoe.

A reinforced pant leg assembly is further provided, including a pant leg having a pant leg lower end with a lower end rearward portion; and elongate reinforcing structure at least four inches in height and having a fastening mechanism for attaching the reinforcing structure to the lower end rearward portion to prevent the lower end rearward portion from bending forwardly and becoming caught between a heel of a wearer foot and the corresponding sole of an open back shoe.

A reinforced pant leg system additionally provided, including pants having two pant legs, each pant leg having a pant leg lower end with a lower end rearward portion; a pair of open back shoes, each open back shoe including a shoe heel having a certain heel height; and a pant leg reinforcing structure fastened to each pant leg lower end rearward portion with a reinforcing structure fastening mechanism and having a height of at least twice the certain heel height; so that the pant leg reinforcing structures prevent the lower end rearward portions from bending sufficiently to become caught between the corresponding open back shoe and a user foot.

Each pant leg preferably includes a pant leg longitudinal axis and each reinforcing structure preferably includes an elongate reinforcing panel oriented substantially parallel to a corresponding pant leg longitudinal axis. The reinforcing structure fastening mechanism preferably includes an adhesive on the reinforcing panel.

The reinforced pant leg system additionally including a removable cover sheet covering the adhesive, so that the cover sheet can be pealed off the reinforcing panel and the panel placed and affixed upright against the lower end rearward portion inner surface. The reinforcing panel preferably is formed of cardstock or cardboard, although use of a suitable plastic is also contemplated.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
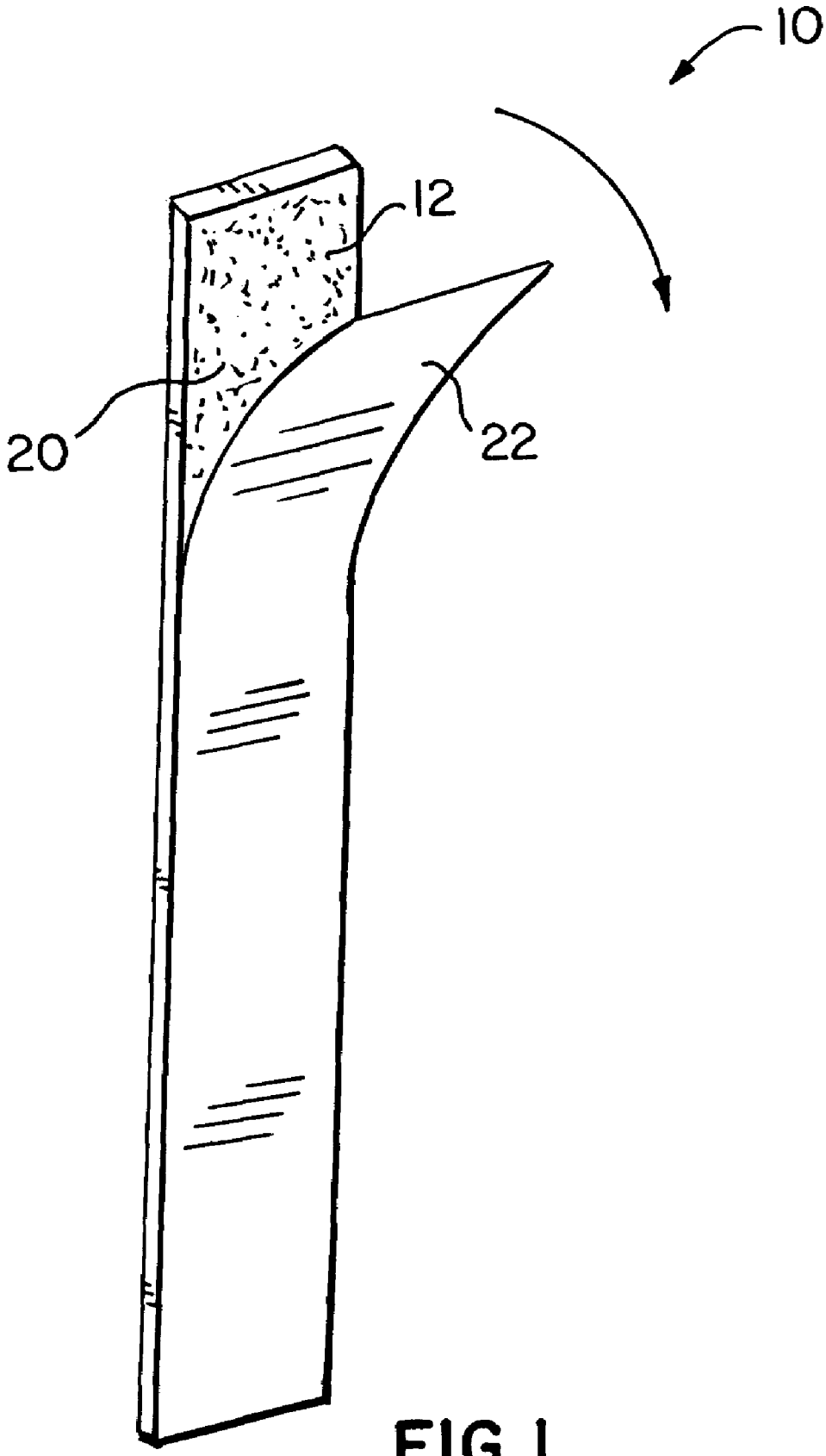
FIG. 1 is a perspective view of a reinforcing structure in the form of a panel with an adhesive cover sheet being peeled away immediately prior to installation on a pant leg.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Figure 2:
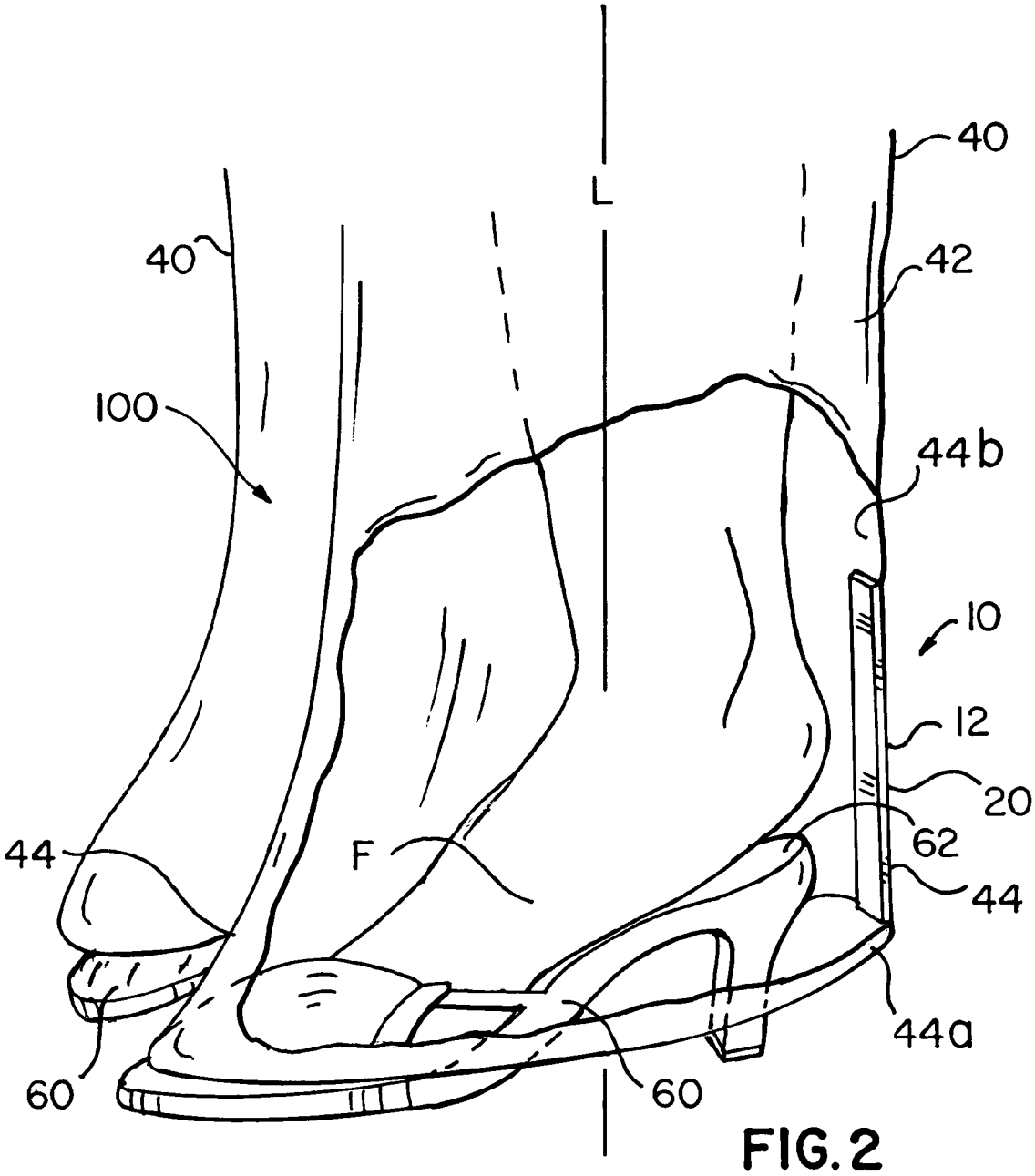
FIG. 2 is a perspective side view of pant leg lower ends of a pair of pants, the forwardmost pant leg having an area broken away to reveal the reinforcing structure mounted to the pant leg lower end rearward portion and a wearer foot in an open back shoe.

Referring to FIGS. 1-2, an upright reinforcing structure 10 with fastening means 20 is disclosed for attachment to the lower end 44 of each pant leg 42 of a pair of pants 40 to prevent the lower end rearward portion 42*a* from bending forwardly and becoming caught between the heel of the wearer foot F and the heel 62 of a corresponding open back shoe 60, and to a shoe and pant leg system 100 combining the reinforcing structure 10 with a pant leg 42 and an open back shoe 60. The system 100 establishes the height relationships between the reinforcing structure 10 and the shoe heel 62 needed to produce the desired function, namely that the height of the reinforcing structure 10 has at least twice times the height of the shoe heel 62 so that the lower end rearward portion 44*a* cannot bend sufficiently to become caught between the wearer shoe 60 and foot F. Height in this instance can be equivalently expressed as the distance the reinforcing structure 10 extends along the pant leg longitudinal axis L. To define the height independently of a given shoe heel 62, the height of the reinforcing structure 10 is at least three inches and preferably four inches.

The reinforcing structure 10 preferably takes the form of an elongate reinforcing panel 10 and the panel fastening means 20 preferably takes the form of an adhesive 20 on a panel first face 12. The panel first face 12 is initially covered by a removable cover sheet 22, so that the cover sheet 22 can be pealed off the panel 10 and the panel first face 12 placed and affixed upright against the lower end rearward portion inner surface 44*b* parallel to the pant leg longitudinal axis, or equivalently referred to as upright. The reinforcing panel 10 is inexpensive and preferably is readily removable from the pant leg 42 to be disposable, so that the pants 40 can be laundered without the panel 10. The preferred reinforcing panel 10 material is cardstock or cardboard, and alternatively can be a resilient or rigid plastic, and is sufficiently thin that it readily can be cut by a purchaser to a desired size.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A reinforced pant leg assembly, comprising:

a pant leg having a pant leg lower end with a lower end rearward portion and an inner surface and having a pant leg longitudinal axis extending from said pant leg lower end upwardly, and lengthwise along said pant leg;

and elongate reinforcing structure at least three inches in height and having a reinforcing structure upper end and a reinforcing structure lower end and having adhesive fastening means at least at said reinforcing structure upper end and at said reinforcing structure lower end attaching said reinforcing structure to the inner surface of said pant leg lower end rearward portion such that the height of said elongate reinforcing structure extends substantially parallel to said pant leg longitudinal axis and such that said elongate reinforcing structure is entirely inside said pant leg to prevent said pant leg lower end rearward portion from bending forwardly and becoming caught between a heel of a wearer foot and the corresponding sole of an open back shoe.

2. A reinforced pant leg assembly, comprising:

a pant leg having a pant leg lower end with a lower end rearward portion and an inner surface and having a pant leg longitudinal axis extending from said pant leg lower end upwardly, and lengthwise along said pant leg;

and elongate reinforcing structure at least four inches in height and having a reinforcing structure upper end and a reinforcing structure lower end and having adhesive fastening means at least at said reinforcing structure upper end and at said reinforcing structure lower end attaching said reinforcing structure to the inner surface of said pant leg lower end rearward portion such that the height of said elongate reinforcing structure extends substantially parallel to said pant leg longitudinal axis and such that said elongate reinforcing structure is entirely inside said pant leg to prevent said pant leg lower end rearward portion from bending forwardly and becoming caught between a heel of a wearer foot and the corresponding sole of an open back shoe.

3. A reinforced pant leg system, comprising:

pants having two pant legs, each said pant leg having a pant leg lower end with a lower end rearward portion and an inner surface and having a pant leg longitudinal axis extending from said pant leg lower end upwardly, and lengthwise along said pant leg;

a pair of open back shoes, each said open back shoe comprising a shoe heel having a certain heel height;

and a pant leg reinforcing structure having a reinforcing structure upper end and a reinforcing structure lower end fastened at said reinforcing structure upper end and at said reinforcing structure lower end to the inner surface of each said pant leg lower end rearward portion such that the height of said elongate reinforcing structure extends substantially parallel to said pant leg longitudinal axis and such that said elongate reinforcing structure is entirely inside said pant leg with reinforcing structure fastening means and having a height of at least twice said certain heel height;

such that said pant leg reinforcing structures prevent said lower end rearward portions from bending sufficiently to become caught between the corresponding open back shoe and a user foot.

4. The reinforced pant leg system of claim 3, wherein each said reinforcing structure comprises an elongate reinforcing panel oriented substantially parallel to a corresponding said pant leg longitudinal axis.

5. The reinforced pant leg system of claim 3, wherein said reinforcing structure fastening means comprises an adhesive on said reinforcing panel.

6. The reinforced pant leg system of claim 5, additionally comprising a removable cover sheet covering said adhesive, such that said cover sheet can be pealed off said reinforcing panel and said panel placed and affixed upright against the cuff inner surface.

7. The reinforced pant leg system of claim 4, wherein said reinforcing panel is formed of one of: cardstock, cardboard and plastic.

* * * * *